US007145539B2

(12) United States Patent
Lim

(10) Patent No.: US 7,145,539 B2
(45) Date of Patent: Dec. 5, 2006

(54) LIQUID CRYSTAL DISPLAY DEVICE AND METHOD OF TESTING THE SAME

(75) Inventor: Joo Soo Lim, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 634 days.

(21) Appl. No.: 09/892,647

(22) Filed: Jun. 28, 2001

(65) Prior Publication Data

US 2002/0039089 A1 Apr. 4, 2002

(30) Foreign Application Priority Data

Sep. 30, 2000 (KR) ..... 10-2000-0057728

(51) Int. Cl.
*G09G 3/36* (2006.01)

(52) U.S. Cl. ..... 345/98; 345/90; 345/87; 345/100; 345/103

(58) Field of Classification Search ..... 345/58, 345/1.3, 87, 1.1, 90, 93, 92, 94, 100, 9, 103, 345/2.1, 904, 903, 204, 97, 89, 505, 63, 98; 324/770, 96; 382/141; 257/59; 704/260; 315/169

See application file for complete search history.

(56) References Cited

U.S. PATENT DOCUMENTS 4,129,804 A * 12/1978 Wiesbrod ..... 315/366
5,491,347 A * 2/1996 Allen et al. ..... 257/59
5,774,133 A * 6/1998 Neave et al. ..... 345/505
5,784,042 A * 7/1998 Ono et al. ..... 345/94
5,844,533 A * 12/1998 Usui et al. ..... 345/89
5,883,609 A * 3/1999 Asada et al. ..... 345/100
6,040,814 A * 3/2000 Murakami et al. ..... 345/94
6,076,060 A * 6/2000 Lin et al. ..... 704/260
6,249,265 B1 * 6/2001 Tajima et al. ..... 345/63
6,275,061 B1 * 8/2001 Tomita ..... 324/770
6,424,331 B1 * 7/2002 Ozawa ..... 345/98
6,433,767 B1 * 8/2002 Murade ..... 345/92
6,437,775 B1 * 8/2002 Hanari ..... 345/204
RE37,847 E * 9/2002 Henley et al. ..... 382/141
6,448,952 B1 * 9/2002 Toyoda et al. ..... 345/97
6,509,887 B1 * 1/2003 Kondoh et al. ..... 345/87
6,545,653 B1 * 4/2003 Takahara et al. ..... 345/87
6,567,065 B1 * 5/2003 Kondoh et al. ..... 345/97
6,611,241 B1 * 8/2003 Firester et al. ..... 345/1.3
6,630,840 B1 * 10/2003 Tomita ..... 324/765
6,714,269 B1 * 3/2004 Huang ..... 349/54
6,750,926 B1 * 6/2004 Ohgiichi et al. ..... 349/40
6,839,046 B1 * 1/2005 Orisaka et al. ..... 345/98
6,924,782 B1 * 8/2005 Fujioka et al. ..... 345/92
6,963,336 B1 * 11/2005 Kimura ..... 345/204

(Continued)

FOREIGN PATENT DOCUMENTS

JP 411237611 A * 8/1999
JP 02000075840 A * 3/2000

*Primary Examiner*—Bipin Shalwala
*Assistant Examiner*—Prabodh Dharia
(74) *Attorney, Agent, or Firm*—McKenna Long & Aldridge LLP

(57) ABSTRACT

A liquid crystal display device and a testing method thereof that that is capable of accurately detecting a point defect existing in a liquid crystal display panel. In the method, scanning lines are scanned in a sequence directing from the low-order lines into the high-order lines, thereby detecting a defect from a test picture displayed on a liquid crystal display panel.

15 Claims, 7 Drawing Sheets

U.S. PATENT DOCUMENTS

2001/0020988 A1* 9/2001 Ohgiichi et al. ..... 349/54
2001/0052788 A1* 12/2001 Tomita ..... 324/765
2003/0034944 A1* 2/2003 Kondoh et al. ..... 345/87
2004/0233344 A1* 11/2004 Ohgiichi et al. ..... 349/40

* cited by examiner

LIQUID CRYSTAL DISPLAY DEVICE AND METHOD OF TESTING THE SAME

CROSS REFERENCES TO RELATED APPLICATIONS

This application claims the benefit of Korean Patent Application No. P2000-57728, filed on 30 Sep. 2000, the entirety of which is hereby incorporated by reference for all purposes as if fully set forth herein.

BACKGROUND OF THE RELATED ART

1. Field of the Invention

This invention relates to a liquid crystal display, and more particularly to a liquid crystal display device and a testing method thereof that is capable of accurately detecting a point defect existing in a liquid crystal display panel.

2. Description of the Related Art

Generally, a liquid crystal display (LCD) controls light transmissivities of liquid crystal cells in response to a video signal to thereby display a picture. An active matrix LCD in which a switching device is provided for each liquid crystal cell is suitable for displaying a moving picture. The active matrix LCD mainly uses a thin film transistor (TFT) as the switching device. Since such an active matrix LCD can be made into a smaller device in size than the existent Brown tube, it has been widely used for personal computers or notebook computers, as well as office automation equipment such as copy machines, etc., and portable equipment such as cellular phones and pagers, etc.

A method of fabricating such an active matrix LCD may be divided into substrate cleaning, substrate patterning, alignment film formation, substrate adhesion/liquid crystal injection, packaging and test processes.

In the substrate cleaning process, a cleaner removes any alien substance on the substrates before and after patterning the upper and lower substrate.

The substrate patterning process is divided into a step of patterning the upper substrate and a step of patterning the lower substrate. The upper substrate is typically provided with color filters, a common electrode and black matrices, etc. The lower substrate is provided with signal wires such as data lines and gate lines, etc. A thin film transistor (TFT) is arranged at each intersection between the data lines and the gate lines. A pixel electrode is formed at each pixel area between the data lines and the gate lines.

In the substrate adhesion/liquid crystal injection process, a step of coating an alignment film on the lower substrate and rubbing it is sequentially followed by a step of adhering the upper substrate to the lower substrate using a seal, a liquid crystal injection step, and an injection hole sealing step.

In the packaging process, a tape carrier package (TCP) mounted with integrated circuits such as a gate drive integrated circuit and a data driver integrated circuit, etc. is connected to a pad portion on the substrate. In the meantime, when the driver circuit is mounted by a chip on glass (COG) system, a circuit pattern is directly mounted onto a polysilicon substrate in said substrate patterning process.

The LCD device may have a defect caused by a process error in its fabrication process, a deterioration of the TFT characteristic, an interference between circuits or a signal delay, etc. upon its driving. In order to detect such a defect, the fabrication process of the LCD device includes a testing process.

In a conventional testing process as shown in FIG. 1, a liquid crystal display panel 8 is scanned from the top to the bottom thereof, that is, in a forward direction to display gray patterns (RGB) for testing on the screen.

The liquid crystal display panel 8 is provided with m gate lines G1, G2, . . . , Gm and n data lines D1, D2, . . . , Dn crossing each other. A TFT 5 is formed at each intersection between the m gate lines G1, G2, . . . , Gm and the n data lines D1, D2, . . . , Dn. The TFT 5 is connected to a pixel electrode to drive a liquid crystal pixel cell 6. Tape carrier packages (TCPs) 1 and 4 are attached to pads of the gate lines G1, G2, . . . , Gm, and the data lines D1, D2, . . . , Dn of the liquid crystal display panel 8 respectively. The TCPs 1 and 4 have mounted thereon integrated circuits (IC's) 2 and 3.

The gate driving TCP 1 and the data driving TCP 4 are controlled by a controller board 7. The data driving TCP 4 is synchronized with a dot clock Dclk from the controller board 7 to apply a gray test pattern for each one line to the data lines D1, D2, . . . , Dn. The gate driving TCP 1 is connected to the controller board 7 to scan the gate lines G1, G2, . . . , Gm sequentially from the first gate line G1 until the $m^{th}$ gate line Gm under control of the controller board 7.

The controller board 7 generates signals for controlling the gate driver IC 2 mounted on the gate driving TCP 1, that is, a gate shift clock GSC, a gate output enable signal GOE and a gate start pulse GSP. The gate shift clock GSC controls a time at which the gate of the TFT 5 is turned on or off. The gate output enable signal GOE is a signal controlling the output of the gate driver IC 2. The gate start pulse GSP is a signal indicating the drive timing of the first scanned gate line of the screen, that is, the first gate line G1 in one vertical synchronous signal.

When the testing gray pattern data RGB is being supplied, via the data driver IC 3, to the data lines D1, D2, . . . , Dn, the controller board 7 controls the gate driver IC 2 to sequentially scan from the first gate line G1 to the $m^{th}$ gate line Gm. At this time, the gate start pulse GSP generated from the controller board 7 is applied to a stage of a shift resister connected to the first gate line G1 and then is sequentially applied to the low-order gate driver ICs 2. In other words, the gate start pulse GSP is applied to the gate driver IC 2 connected to the first gate line G1 and then is eventually applied to the gate driver IC 2 connected to the $m^{th}$ gate line Gm (GSP_L→GSP_H). If the gate lines G1, G2, . . . , Gm are sequentially driven, then a channel is defined in each of the corresponding TFTs 5, to thereby supply data on the data lines D1, D2, . . . , Dn to the liquid crystal pixel cells. Then, the gray test pattern is displayed on the screen. The testing process operator observes the screen using a microscope to judge a defect of the liquid crystal pixel cell.

However, according to the conventional testing process, since an electric field applied to the liquid crystal pixel cell 6 is small, the brightness of the displayed test picture is not high. For this reason, it is impossible to find a point defect of the liquid crystal display panel 8, particularly to accurately find a point defect existing at the edge of the liquid crystal display panel 8. For instance, if a test data voltage of 6V is applied to the liquid crystal pixel cell 6 when a gate low voltage and a gate high voltage are −5V and 20V, respectively, then a voltage of 11V is charged in the liquid crystal pixel cell 6 at a positive electric field because the gate low voltage Vgl is −5V. In this case, it becomes difficult to find point defects existing in the edge areas 8A and 8B of the liquid crystal display panel 8 as shown in FIG. 2.

SUMMARY OF THE INVENTION

Accordingly, it is an object of the present invention to provide a liquid crystal display device and a testing method thereof that that is capable of accurately detecting a point defect existing in a liquid crystal display panel.

In order to achieve these and other objects of the invention, a liquid crystal display device according to one aspect of the present invention includes a liquid crystal display panel having a plurality of data lines and a plurality of scanning lines crossing each other and liquid crystal pixel cells arranged in a matrix; a data driver circuit for supplying data to the data lines; a scanning driver circuit for supplying a scanning signal to the scanning lines; and control means for controlling the data driver circuit and the scanning driver circuit, wherein said control means controls the scanning driver circuit such that the liquid crystal display panel is scanned in a reverse-sequential manner upon testing of the liquid crystal display panel.

In the liquid crystal display device, the control means generates a gate start pulse for indicating a start position of the scanning signal, a mode setting signal for assigning an application direction of the scanning signal to either of a forward direction or a reverse direction, and a gate output enable signal for controlling an output of the scanning driver circuit. Also, the control means applies a dot clock for indicating an application time of said data to the data driver circuit.

A method of testing a liquid crystal display panel according to another aspect of the present invention includes the steps of setting a plurality of scanning lines to a reverse mode; scanning the scanning lines in a sequence proceeding from the low-order lines to the high-order lines; and detecting a defect from a test picture displayed on the liquid crystal display panel.

In the method, said scanning step includes driving a driver circuit for driving said low-order lines, and thereafter driving a driver circuit for driving said high-order lines.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
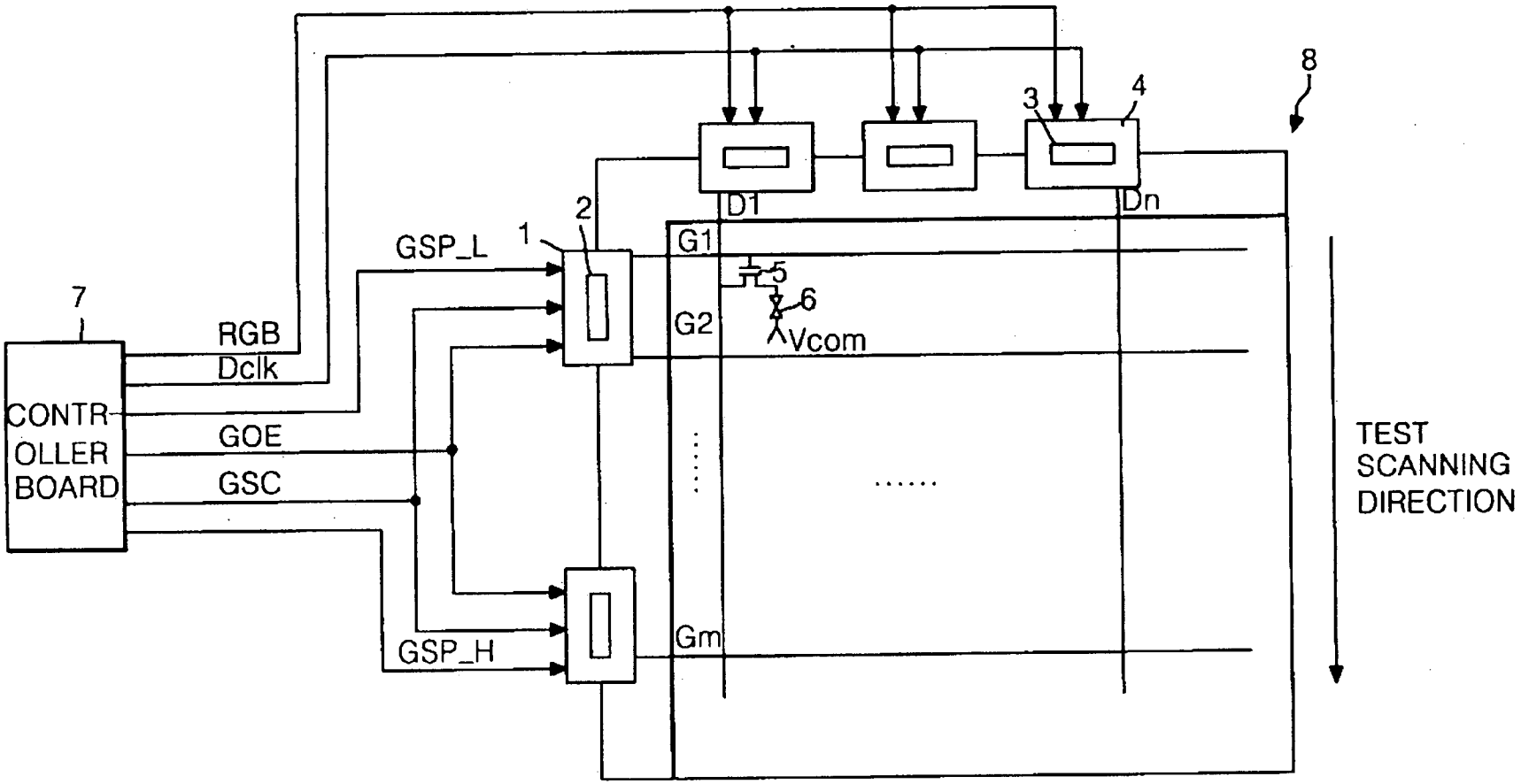
FIG.1 CONVENTIONAL ART
FIG. 1 is a schematic block circuit diagram showing a configuration of a conventional liquid crystal display device.
Figure 2:
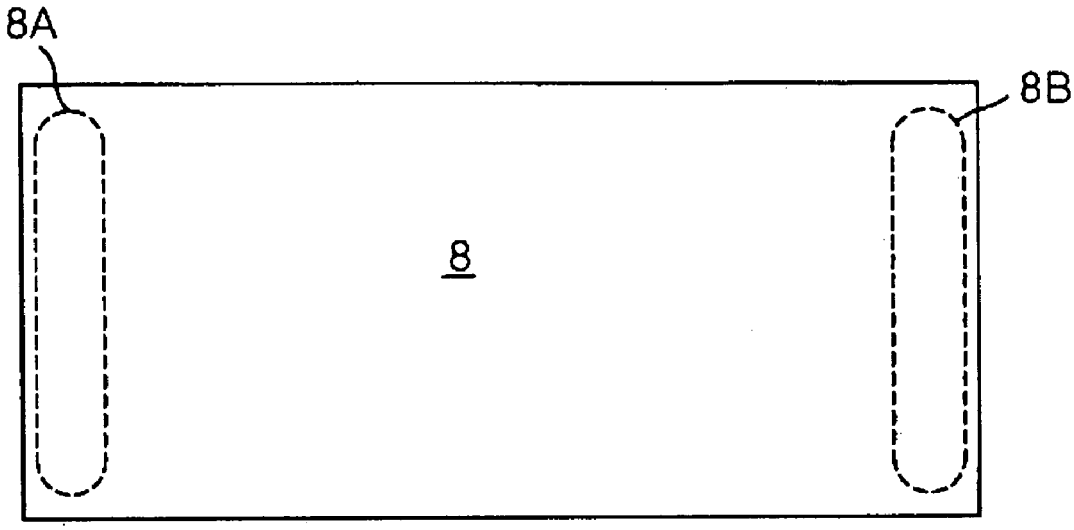
FIG. 2 CONVENTIONAL ART
FIG. 2 illustrates the edge areas at which point defects are not found in a method of testing the conventional liquid crystal display device.
Figure 3:
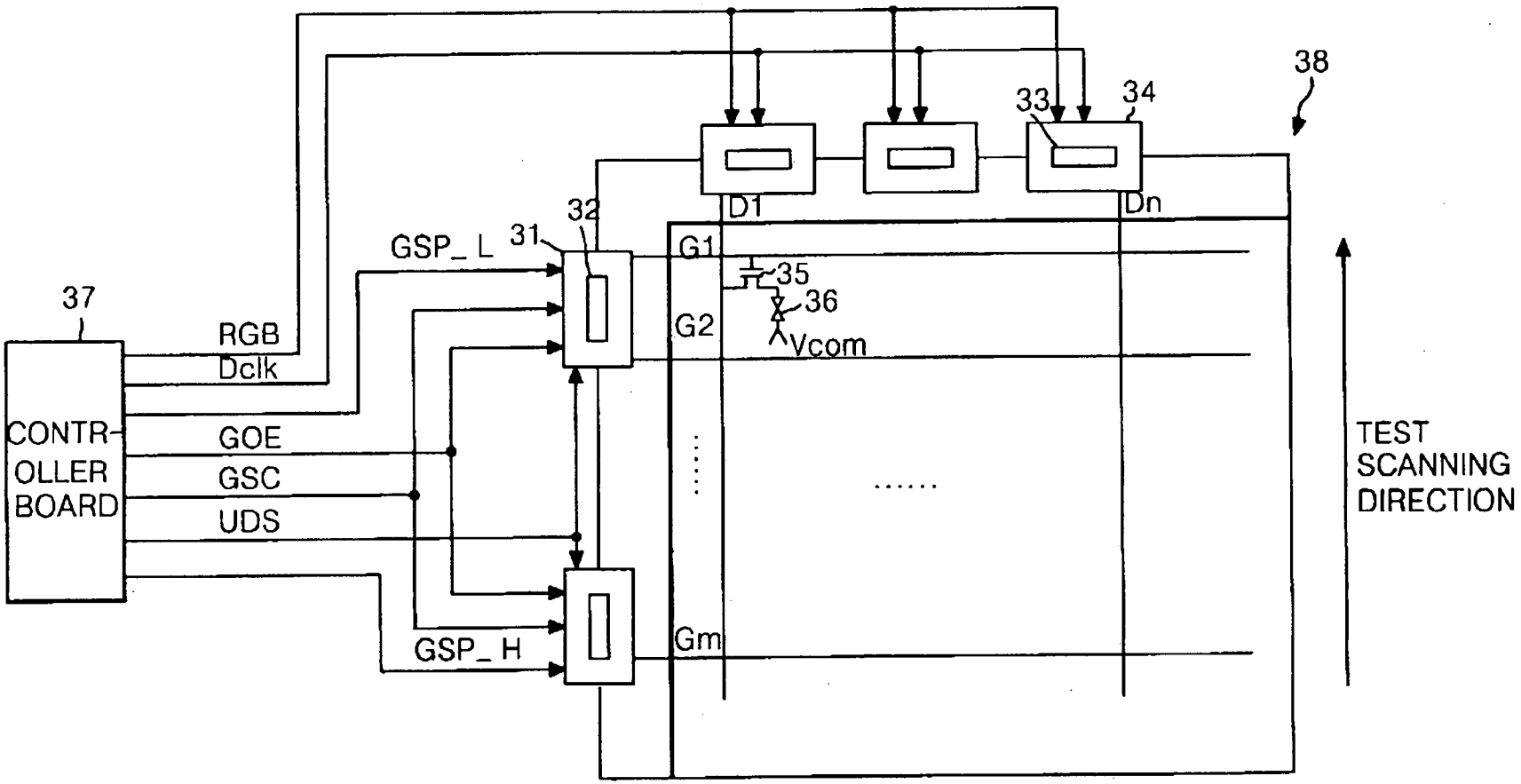
FIG. 3 is a schematic block circuit diagram showing a configuration of a liquid crystal display device according to an embodiment of the present invention.

Referring to FIG. 3, there is shown a liquid crystal display (LCD) device according to an embodiment of the present invention.

In a method of testing the LCD according to the embodiment of the present invention, a liquid crystal display panel 10 is scanned from the bottom to the top thereof, that is, in the reverse direction to display a gray test pattern on the screen.

The LCD device includes: a liquid crystal display panel 38 having liquid crystal pixel cells 36 arranged in a matrix and TFTs 35 positioned at each intersection between m gate lines G1, G2, . . . , Gm and n data lines D1, D2, . . . , Dn crossing each other, data driving TCPs 34 for driving the data lines D1, D2, . . . , Dn of the liquid crystal display panel 38, gate driving TCPs 31 for driving the gate lines G1, G2, . . . , Gm, and a controller board 37 for controlling the data driving TCPs 34 and the gate driving TCPs 31.

The gate driving TCP 31 and the data driving TCP 34 are attached to pads of the gate lines G1, G2, . . . , Gm and the data lines D1, D2, . . . , Dn of the liquid crystal display panel, respectively. The TCPs 31 and 34 are mounted with driver ICs 32 and 33.

The controller board 37 applies a mode setting signal UDS, a gate shift clock GSC, a gate output enable signal GOE, and gate start pulses GSP_L and GSP_H to the gate driving TCPs 31. Herein, the mode setting signal UDS is a control signal for determining whether the gate lines G1, G2, . . . , Gm are driven in either a forward direction (G1→Gm) or a reverse direction (Gm→G1). In the testing process, the mode setting signal UDS is set in the reverse direction to scan the liquid crystal display panel 38 from the bottom to the top thereof. Further, the controller board 37 applies a testing gray pattern (RGB) along with a dot clock Dclk to the data driving TCP 34 to control the data driving TCP 34.

The data driving TCP 34 is synchronized with the dot clock Dclk from the controller board 37 to supply a testing gray pattern, for each one line, to the data lines D1, D2, . . . , Dn. The gate driving TCP 31 scans the gate lines G1, G2, . . . , Gm reverse-sequentially from the $m^{th}$ gate line Gm to the first gate line G1 under control of the controller board 37 in the testing process.

Hereinafter, a method of testing the LCD device according to an embodiment of the present invention will be described step by step.

First, the controller board 37 is set to a reverse test mode. When a testing gray pattern data RGB is being supplied, via the data driver IC 34, to the data lines D1, D2, . . . , Dn, the controller board 37 applies a gate start pulse GSP to the last gate driver IC 32 connected to the $m^{th}$ gate line Gm. The controller board 37 sequentially applies the gate start pulse GSP to the gate driver ICs 32 in a reverse-sequential manner, and finally applies the gate start pulse GSP to the first gate driver IC 32 connected to the first gate line G1 (Gm→G1). To this end, a bilateral shift resister is preferably used for the gate driver IC 32. For example, a driver IC for an analog to digital converter (ADC) may be used as the gate driver IC 32. As the gate driver ICs 32 are shifted in the reverse direction, a test voltage is sequentially charged in the liquid crystal pixel cell 36 connected to the $m^{th}$ gate line Gm, up through the liquid crystal pixel cell 36 connected to the first gate line G1 to display a gray pattern on the screen.

If the gate lines G1, G2, . . . , Gm are driven in the reverse direction, then an effective voltage Vrms charged in the liquid crystal pixel cell 36 at a positive electric field becomes at least 0.5 mV higher than if the gate lines are driven in the forward direction. Accordingly, an electric field applied to the liquid crystal pixel cell 36 is increased to that extent to increase the brightness of the test picture, so that a minor defect of the liquid crystal pixel cell 36 also can be easily found. As a result, a snow phenomenon which is difficult to find when forward driving the circuit, that is, tens to hundreds of point defects 40, emerges at the edges 38A and 38B of the liquid crystal display panel 38. This feature will be described in association with FIGS. 5 to 8, as follows.

The voltage charged into the liquid crystal cell will be explained through a comparison of a forward scanning and a reverse scanning.

Figure 5:
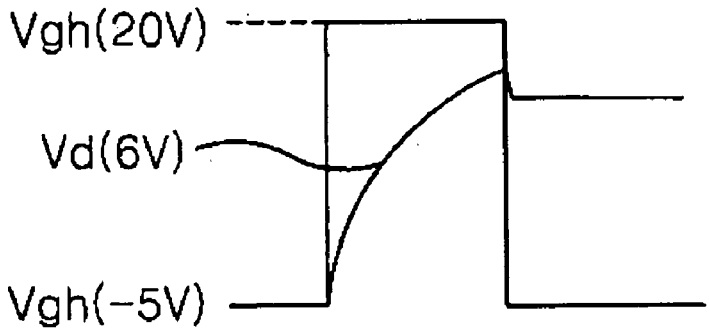
FIG. 5 is a waveform diagram showing a scanning pulse applied to the gate line and a voltage charged in the liquid crystal cell.

For the convenience of explanation, we assume that the gate low voltage Vgl, the gate high voltage Vgh and data voltage Vd are −5V, 20V and 6V, respectively, as shown in FIG. 5.

Figure 6:
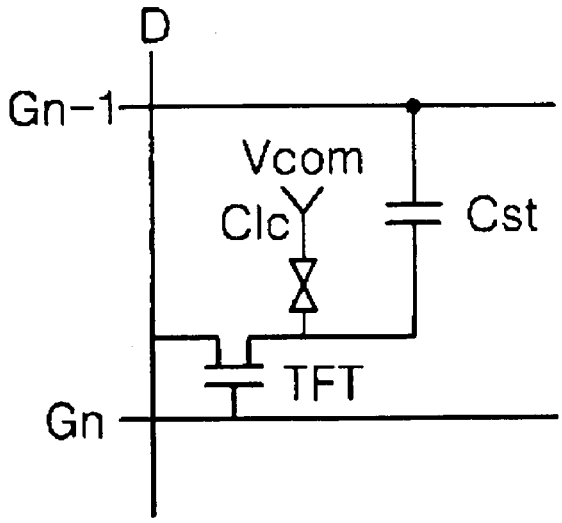
FIG. 6 is a circuitry diagram showing equivalently a storage capacitor connected to the liquid crystal cell and the previous gate line.

Referring to FIG. 6, a liquid crystal cell 36 is connected to a storage capacitor Cst. The liquid crystal cell 36 charges a data voltage Vd and a voltage discharged from the storage capacitor Cst.

The storage capacitor Cst is formed between a (m−1)th gate line Gm−1 and a pixel electrode of the liquid crystal cell 36 to restrain a voltage variation in the liquid crystal cell 36 due to a parasitic capacitance of a thin film transistor (TFT) 35, thereby reducing a flicker. Wherein "m" is an integer of at least 2.

Figure 7:
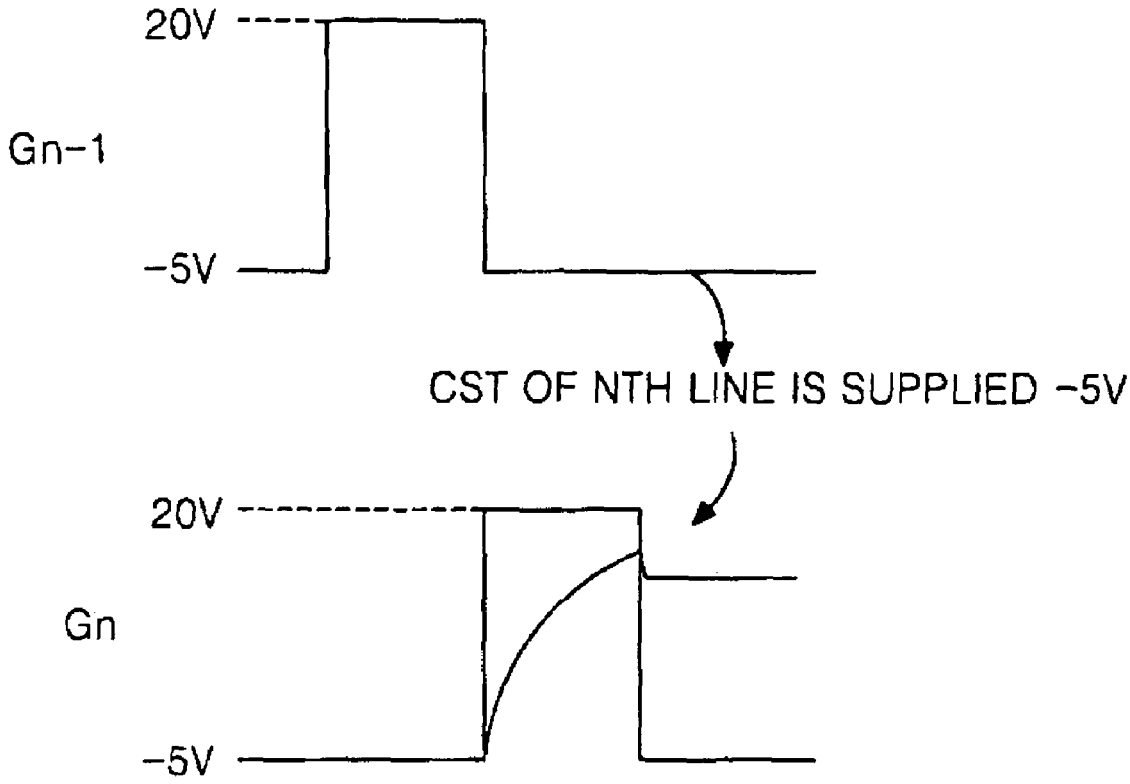
FIG. 7 is a waveform diagram showing a voltage charged in the liquid crystal cell at a forward scanning.

At the forward scanning, a mth gate line Gm is scanned after scanning of (m−1)th gate line Gm−1, as shown in FIG. 7. In this case, the storage capacitor Cst connected to the liquid crystal cell 36 on the mth gate line Gm receives the gate low voltage Vgl, i.e., −5V, during a charging/holding period of the liquid crystal cell 36.

Figure 8:
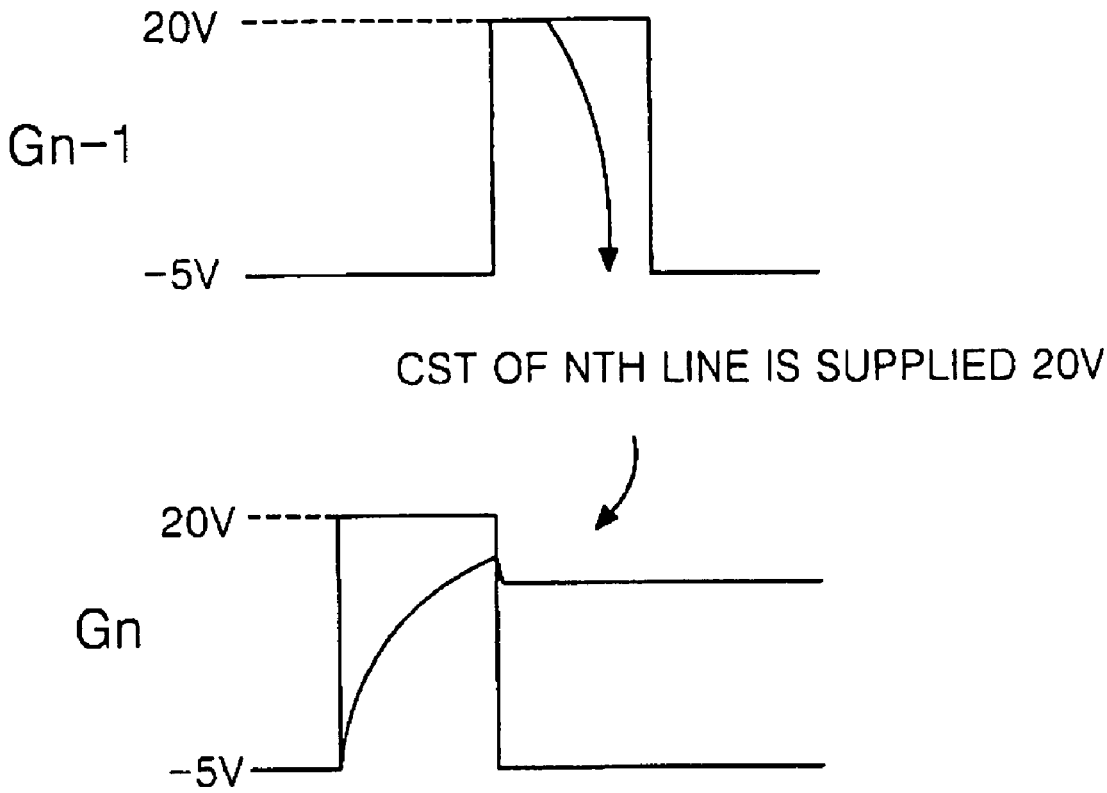
FIG. 8 is a waveform diagram showing a voltage charged in the liquid crystal cell at a reverse scanning.

Meanwhile, at the reverse scanning, the mth gate line Gm is scanned before scanning of the (m−1)th gate line Gm−1, as shown in FIG. 8. The storage capacitor Cst connected to the liquid crystal cell 36 on the mth gate line Gm receives the gate high voltage Vgh, that is, 20V, during the charging/holding period of the liquid crystal cell 36.

Figure 4:
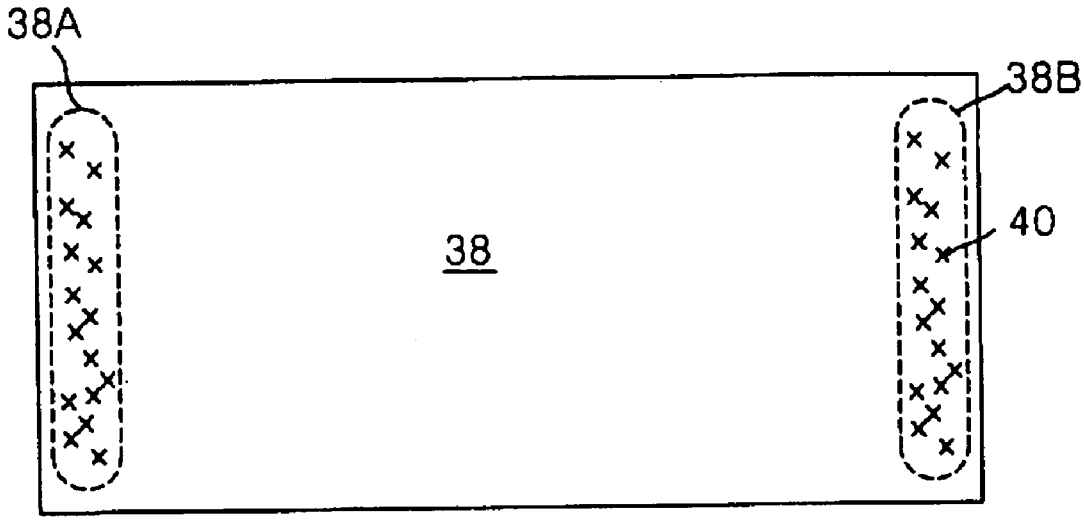
FIG. 4 shows point defects emerging at the edges of the liquid crystal display panel by a reverse-sequence system.

If the data voltage of 6V is applied to the liquid crystal cell 36 at the reverse scanning, the liquid crystal cell 36 on the mth gate line Gm further charges a voltage of 14V at the scanning of (m−1)th gate line Gm−1. This is because the liquid crystal cell 36 on the mth gate line Gm receives a different voltage of 14V between the data voltage Vd of 6V on a data line Di and the gate high voltage Vgh on the (m−1)th gate line Gm−1 at the scanning of the (m−1)th gate line Gm−1. Accordingly, although the data voltage Vd is low, an effective voltage applied to the liquid crystal cell 36 at the reverse scanning becomes at least 0.5 mV higher than that at the forward scanning. As a result, the snow phenomenon as shown in FIG. 4 represents apparently.

For instance, if a data voltage Vd of 6V is applied when a gate low voltage and a gate high voltage are −5V and 20V, respectively, then a gate low voltage Vgl applied to the liquid crystal pixel cell 8 becomes equal to a gate high voltage Vgh of 20V, so that 14V is charged in the liquid crystal pixel cell 36 at a positive electric field. Even when a low-level data voltage Vd as mentioned above is applied, a snow phenomenon can definitely appear at the liquid crystal display panel 10. If the gate high voltage Vgh is increased, then point defects 40 appear more definitely. Furthermore, upon reverse driving, a current characteristic (ion current) indicating an electric charge amount passing through the channel of the TFT 35 is decreased, so that an on/off switching characteristic is increased to increase the switching speed.

Meanwhile, point defects 40 having more than a predetermined amount is founded in the testing process, the liquid crystal display panel 38 is repaired in the repair process or destroyed. On the other hand, the liquid crystal display panel 38 determined to have a good quality in the testing process come into the market with the mode setting signal UDC being fixed to any one mode.

As described above, according to the present invention, the liquid crystal display panel is driven in a reverse-sequential manner by means of the controller board generating a signal for controlling a scanning direction in the testing process. Accordingly, a test data is displayed on the liquid crystal pixel cells in the reverse direction, thereby accurately detecting point defects on the liquid crystal display panel.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device, comprising:

a liquid crystal display panel having a plurality of data lines and a plurality of scanning lines crossing each other and liquid crystal pixel cells arranged in a matrix;

a data driver circuit for supplying data to the data lines;

a scanning driver circuit for supplying scanning signals to the scanning lines; and control means for controlling the data driver circuit and the scanning driver circuit, wherein said control means controls the scanning driver circuit such that the liquid crystal display panel is scanned in a reverse-sequential manner upon testing of the liquid crystal display panel to display an image at an increased brightness, and detecting a defect from the image displayed on the liquid crystal display panel at an increased brightness.

2. The liquid crystal display device according to claim 1, further comprising a switching device arranged at each intersection between the data lines and the scanning lines to drive the liquid crystal pixel cell in response to the scanning signal.

3. The liquid crystal display device according to claim 2, wherein said switching device consists of a thin film transistor including a gate electrode connected to a corresponding one of the scanning lines to receive the scanning signal; a source electrode connected to a corresponding one of the data lines to receive said data; and a drain electrode opposed to the source electrode with a desired channel therebetween and connected to a pixel electrode for driving the liquid crystal pixel cell.

4. The liquid crystal display device according to claim 1, wherein said control means generates a gate start pulse for indicating a start position of the scanning signal, a mode setting signal for assigning an application direction of the scanning signal to any one of a forward direction and a reverse direction, and an output enable signal for controlling an output of the scanning driver circuit.

5. The liquid crystal display device according to claim 1, wherein said control means applies a dot clock for indicating an application time of said data to the data driver circuit.

6. The liquid crystal display device according to claim 1, wherein said scanning driver circuit consists of a bilateral shift register in which its shift direction is controlled in response to a mode setting signal.

7. The liquid crystal display device according to claim 1, wherein said control means controls the scanning driver circuit such that the liquid crystal display panel is scanned in a forward-sequential manner upon normal operation of the liquid crystal display panel.

8. A method of testing a liquid crystal display panel including a plurality of scanning lines, comprising:

setting the scanning lines to a reverse scanning mode;

scanning the scanning lines in a sequence proceeding from low-order lines to high-order lines to display a test picture at an increased brightness; and detecting a defect from the test picture displayed on the liquid crystal display panel.

9. The method according to claim 8, wherein scanning the scanning lines includes driving a drive circuit for driving said low-order lines and thereafter driving a drive circuit for driving said high-order lines.

10. The method according to claim 8, wherein said reverse mode is set by a mode setting signal that is applied to a scanning driver circuit generating a scanning signal, to thereby indicate an application direction of the scanning signal.

11. The method according to claim 8, wherein scanning the scanning lines in a sequence proceeding from low-order lines to high-order lines comprises shifting a shift register in a reverse direction.

12. A liquid crystal display device, comprising:

a liquid crystal display panel having a plurality of data lines and a plurality of gate lines crossing each other and liquid crystal pixel cells arranged where the gate lines cross the data lines;

a data driver circuit for supplying data to the data lines;

a gate driver circuit for sequentially supplying a gate signal to the gate lines in a forward sequential order upon normal operation, and sequentially supplying the gate signal to the gate lines in a reverse sequential order upon testing the device to increase the brightness of the display upon testing compared to the brightness under normal operation; and a defect detection circuit for detecting a defect in the display during testing under increased brightness.

13. The liquid crystal display device of claim 12, wherein the gate driver circuit comprises a shift register having a control terminal for controlling a sequential order of supplying the gate signal to the gate lines.

14. The liquid crystal display device of claim 12, further comprising a controller supplying a mode setting signal to the control terminal.

15. A method of testing a liquid crystal display panel, having a plurality of data lines and a plurality of gate lines crossing each other and a plurality of liquid crystal pixel cells arranged where the gate lines cross the data lines, the method comprising:

applying data voltages to the data lines;

applying a mode setting signal to a gate driver connected with the gate lines;

sequentially scanning the gate lines in a direction identified by the mode setting signal to display a test pattern on the display panel at an increased brightness; and identifying any defective pixel cells among the plurality of liquid crystal pixel cells from the test pattern.

* * * * *